United States Patent [19]

Ito et al.

[11] Patent Number: 4,902,263

[45] Date of Patent: Feb. 20, 1990

[54] COIN LIFTING DEVICE

[75] Inventors: Tsuyoshi Ito; Masaharu Shirasawa, both of Tochigi, Japan

[73] Assignee: Kabushiki Kaisha Universal, Tochigi, Japan

[21] Appl. No.: 210,787

[22] Filed: Jun. 24, 1988

[30] Foreign Application Priority Data

Jun. 26, 1987 [JP] Japan ..... 62-157770

[51] Int. Cl.[4] ..... G07D 1/00; G07D 9/00

[52] U.S. Cl. ..... 453/49; 453/53; 453/57; 221/75; 221/237; 221/277; 198/392; 198/454; 198/467.1

[58] Field of Search ..... 453/29, 30, 32, 39, 453/40, 49, 53, 54, 57, 58, 61, 62, 63, 18, 51; 221/75, 164, 192, 254, 167, 175, 178, 179, 181, 231, 237, 277; 414/93, 94; 198/392, 454, 467.1, 803.16

[56] References Cited

U.S. PATENT DOCUMENTS

| | | | |
|---|---|---|---|
| 913,134 | 2/1909 | Hill | 221/178 |
| 1,627,791 | 5/1927 | Macy | 414/93 X |
| 1,718,801 | 6/1929 | Reid et al. | 453/30 X |
| 1,750,310 | 3/1930 | Jonkel et al. | 221/277 X |
| 3,365,048 | 1/1968 | Ehrlich et al. | 221/175 X |
| 3,381,694 | 5/1968 | Lempke | 453/57 |
| 3,396,737 | 8/1968 | Picollo | 453/57 X |
| 3,712,487 | 1/1973 | Eberle | 414/94 |
| 3,814,283 | 6/1974 | Cioth | 221/192 X |
| 3,861,408 | 1/1975 | Hatanaka et al. | 453/57 |
| 4,518,001 | 5/1985 | Branham | 221/267 X |

FOREIGN PATENT DOCUMENTS

| | | |
|---|---|---|
| 17925 | 5/1986 | Japan . |
| 288288 | 12/1986 | Japan . |

*Primary Examiner*—Joseph J. Rolla
*Assistant Examiner*—Edward S. Ammeen
*Attorney, Agent, or Firm*—Young & Thompson

[57] ABSTRACT

A rotating disk is rotated about an upright axis to feed coins placed thereon toward a rotating body. The rotating body is formed with a spiral groove in which the periphery of each coin is inserted and a guide barrel is disposed in such a manner as to maintain the rising coins in the groove in the rotating body. The coin, the periphery of which are engaged in the spiral groove, are received by the guide barrel and lifted in a generally horizontal posture by the rotation of the rotating body and then discharged outside from a discharge port formed at an upper portion of the guide barrel. A rubber-surfaced roller is disposed opposite the rotating body. The roller is adapted to press against the periphery of coins thereby to ensure the insertion of the coins into the spiral grooves.

5 Claims, 4 Drawing Sheets

COIN LIFTING DEVICE

BACKGROUND OF THE INVENTION

This invention relates to a device for feeding coins upwardly (hereinafter referred to as a "coin lifting device", and more particularly to a coin lifting device in which a coin (including a token) is held by the periphery thereof by a spiral groove and lifted in a horizontal posture.

As described in Japanese Utility Model Publ. No. Sho 61-17925, there are known coin lifting devices which comprise a hopper with a rotating disk disposed at an angle in a bucket, and a sleeve-shaped chute connected to an outlet port of the hopper. Coins fed one by one from the hopper are pushed into the chute, thereby to push up coins in a row in the chute one by one. Japanese Patent Appln. Early Laid-open Publ. No. Sho 61-288288 also discloses a coin lifting device which comprises a rotating body with a spiral ridge formed on the outer peripheral surface thereof, and a vertical cylindrical housing covering the rotating body. In this device, a coin insertion slot is formed in a lower part of the cylindrical housing and coins on edge enter a narrow space defined by the spiral ridge. Upon rotation of the rotating body within the cylindrical housing, the coins held vertical in the space defined by the spiral ridge are lifted by the spiral ridge.

In the first-mentioned conventional coin lifting device, the upper part of the chute is vertical but the lower part is inclined to lie in the same plane as the rotating disk of the hopper. In this way, in order to erect the coins gradually within the chute, the chute is curved at its lower part to form a general J-shape. This inevitably requires a large installation space for the chute. Therefore, a conventional coin lifting device of this type inevitably is large in size.

On the other hand, in the second-mentioned conventional coin lifting device, coins are lifted on edge. Therefore, it is practically impossible to lift a large number of coins per unit time and the speed of discharging coins is low.

OBJECT OF THE INVENTION

It is therefore an object of the present invention to provide a coin lifting device which requires a small installation space and which is capable of lifting a large number of coins in a short time.

SUMMARY OF THE INVENTION

In order to achieve the above object, a coin lifting device according to the present invention comprises a rotating disk which is horizontally rotated so as to feed coins, and a rotating body provided with a spiral groove, into which a part of the periphery of each of the coins fed in a horizontal posture by the rotating disk is inserted. A guide barrel guides the coins having the periphery thereof in the spiral groove, so that the coins do not revolve around the rotating body despite the rotation of the rotating body. A coin discharge port is formed in an upper portion of the guide barrel.

According to the present invention, since the coins are fed by a rotating body which rotates about an upright axis, and are inserted in a spiral groove of the rotating body and are vertically lifted in a generally horizontal posture, the device can be made small in size. Moreover, since each coin is lifted in a horizontal posture, the coins can be closely spaced and a large number of coins can be lifted in a short time.

BRIEF DESCRIPTION OF THE DRAWINGS

One preferred embodiment of the present invention will be described hereinafter with reference to the accompanying drawings, in which:

FIG. 4 is a schematic view showing a use example of the embodiment of FIG. 1

DETAILED DESCRIPTION OF THE INVENTION

Figure 1:
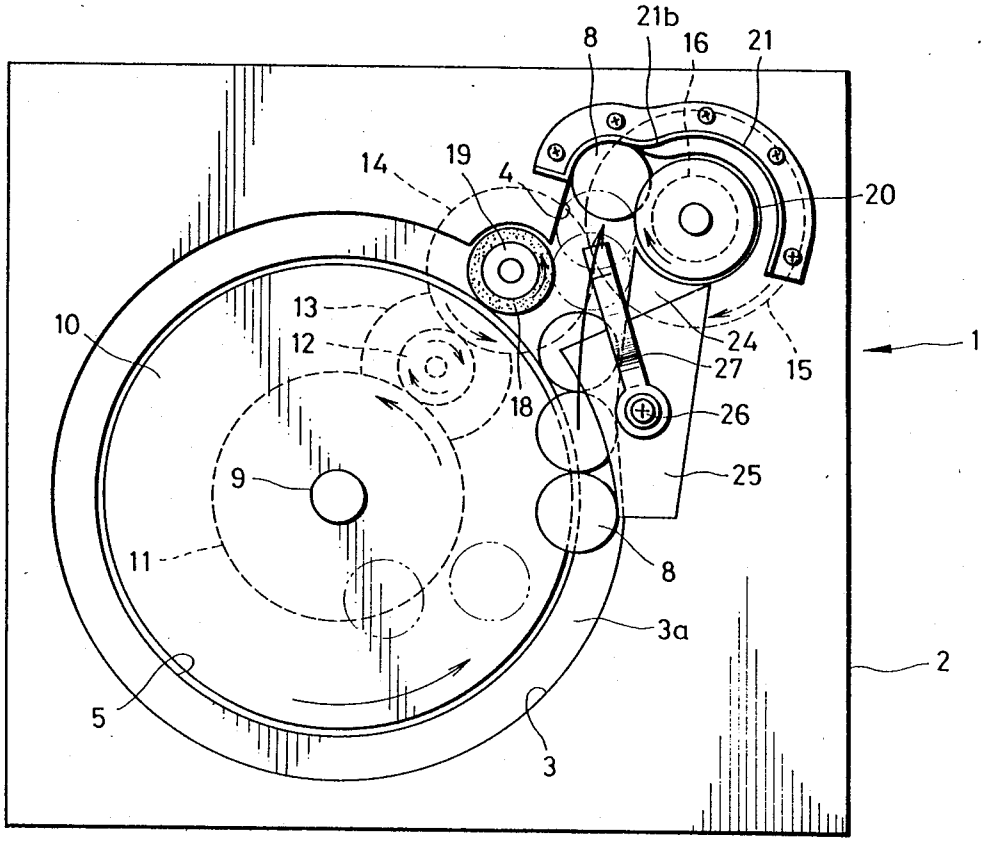
FIG. 1 is a plan view of a preferred embodiment of the present invention.

In FIG. 1, a coin lifting device 1 is provided with a horizontal base plate 2 and a motor 13 mounted on the under surface of the base plate 2. The motor 13 is provided with a gear 12 secured to its shaft. Gears 11 and 14 mesh with the gear 12 but from opposite sides. The gear 11 is connected with a rotating disk 10 through a shaft 9. The gear 14 is provided with a roller 19 secured thereto. The roller 19 is provided at its periphery with a sleeve 18 of rubber having a high coefficient of friction and an excellent durability.

As is also shown in FIG. 1, the base plate 2 is formed at the central portion of its upper surface with a circular recess 3 and a passageway 4 which have a common flat bottom surface 3*a*. The circular recess 3 is formed at its central portion with a circular recess 5 therein. The rotating disk 10 is mounted in the recess 5 such that the upper surface of the rotating disk 10 lies in the same plane as the bottom surface 3*a* of the circular recess 3 and passageway 4. The roller 19 is disposed at the junction between the circular recess 3 and the passageway 4. A rotating body in the form of a rotating column 20 is mounted in a corner in the passageway 4 in such a manner as to be vertically rotatable with respect to the base plate 2. The rotating column 20 is coaxial with and secured to a gear 15 which meshes with the gear 14 and thus is rotated by the motor 13 together with the rotating disk 10. The rotating column is preferably hollow inside in order to reduce its weight.

Figure 3:
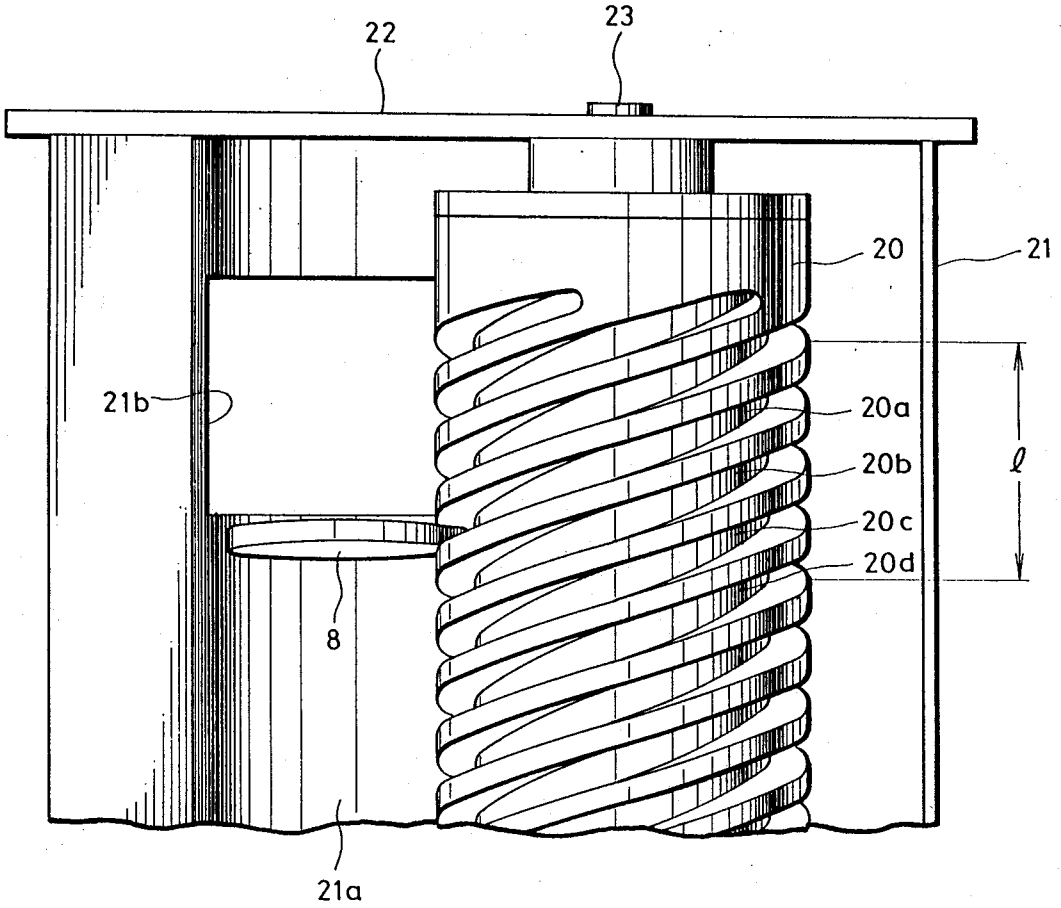
FIG. 3 is a front view showing an upper portion of a rotating column.

The rotating column 20 is formed with a spiral groove having a width slightly greater than the thickness of a coin so that a part of the periphery of the coin can be inserted therein. In the embodiment shown in FIG. 3, four spiral grooves 20*a*, 20*b*, 20*c* and 20*d* are provided, and a coin 8 is lifted by a distance l corresponding to one pitch while the rotating column 20 makes on rotation. Adjacent to the rotating column 20, a guide barrel 21 is mounted on the base plate 2. The wall surface 21*a* of the guide barrel 21 prevents the coins 8, which are engaged in the grooves, from revolving around the rotating column 20, despite the rotation of the rotating column 20 and, at the same time, acts as a guide when the coins 8 are lifted. The guide barrel 21 is provided at its upper portion with a discharge port 21*b* for discharging the lifted coins 8. The guide barrel 21 is provided with a top closure plate 22 mounted on its upper end. The plate 22 acts as a bearing for a shaft 23 of the rotating column 20. Of course, although only one coin is shown in FIG. 3 for simplicity, it will be understood that there will in practice be a coin in each pitch of each groove 20*a*–20*d*.

Figure 2:
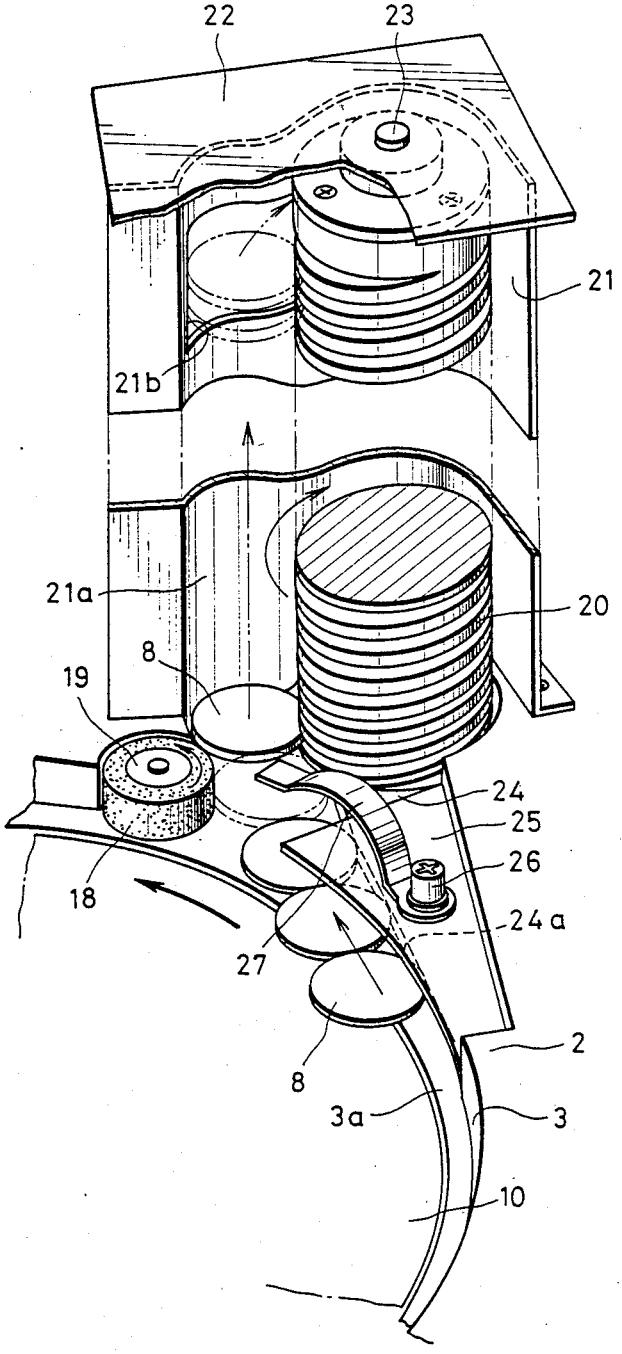
FIG. 2 is a perspective view showing an important portion of the embodiment of FIG. 1.

In FIG. 2, in order to form the passageway 4, there is provided a horizontal plate 24 having on its edge a guide surface 24*a* for the edges of coins. Superposed on plate 24 is a plate 25 which is spaced above bottom surface 3*a* a distance to permit only one coin to pass therebeneath in a horizontal posture. A screw 26 maintains plates 24 and 25 assembled. By this screw, a leaf spring 27 is also secured on plate 25 and overhangs plate 25 in the direction of movement of the coins.

Because the plate 25 extends near the periphery of rotating column 20, the arriving coins 8 can be more effectively regulated as to position. However, plate 25 must not be too near to column 20, since the spiral groove of the rotating column 20 is inclined with respect to the horizontal direction, and so the coins 8 would be unable to enter smoothly into the spiral grooves if plate 25 extended all the way to the grooves. To this end, a space is provided between the plate 25 and the rotating column 20. A free end of the spring 27 is disposed in this space so as to press against the coins and effectively take over the function of plate 25 in this space. At the same time, when the coin 8 is progressively inserted into the spiral groove and thus progressively inclined, spring 27 is deformed upwardly in accordance with the degree of this inclination.

When coins 8 jam on the rotating disk 10, the motor 13 is caused to rotate reversely. At this time, if the rotating column 20 were also rotated reversely, the coins 8 engaged in the spiral grooves of the rotating column 20 would be disengaged from the spiral groove and would drop to the base of the rotating column 20. But since these coins also engage in the grooves of the rotating column 20, the coins could become clogged at this point. Therefore, when coins 8 jam on the rotating disk 10, it is preferable that only the rotating disk 10 be rotated reversely and that the rotating column 20 not be rotated reversely. To this end, a one-way clutch 16 is disposed between the gear 15 and the rotating column 20.

The coin lifting device 1 according to the present invention is installed within, for example, a money changer 30 as shown in FIG. 4. Ball dispensing machines 41 for dispensing game balls are each disposed between the adjacent game machines such as, for example, pinball game machines 40. Under the ball dispensing machines 41, a belt conveyor 42 is disposed. When coins 8 are inserted into the ball dispensing machine 41 in order to obtain game balls, these coins 8 drop onto the belt conveyor 42 whence they are dropped onto the rotating disk 10 of the coin lifting device 1. The rotating disk 10 is provided on its upper side with a bucket having an opening at its bottom. Since the coins 8 transferred by the belt conveyor 42 flow down through the bucket, a properly controlled flow of coins 8 can thus be fed onto the upper surface of the rotating disk 10.

The function of the above-described embodiment will now be set forth. When the gear 12 is rotated by the motor 13, the rotating disk 10 is rotated counterclockwise through the gear 11 meshing with the gear 12. The roller 19 is rotated counterclockwise through the gears 12 and 14, and the rotating column 20 is rotated clockwise through the gears 14 and 15. The coins 8 supplied by the belt conveyor 32 are dropped onto the rotating disk 10, and then moved toward the periphery of the rotating disk 10 due to the centrifugal force imparted to them by the rotation of the rotating disk 10. After the periphery of each coin 8 is contacted by the wall of the circular recess 3, the coins 8 are rotated along the wall of the circular recess 3 together with the rotating disk 10.

When the coins 8 which were moved along the wall of the circular recess 3 arrive at the guide surface 24*a*, which forms a continuation of the wall of the circular recess 3, they are guided by the guide surface 24*a* and plate 25 into the passageway 4. The coins 8, which have entered into the passageway 4, are moved farther by the roller 19 rotating counterclockwise, and the periphery of each coin 8 is pushed into a spiral groove of the rotating column 20. Since the spiral grooves are inclined with respect to the base plate 2, the coins 8 are inserted into the spiral grooves of the rotating column 20 at a slight inclination. At this time, the spring plate 27 presses against the upper surface of each coin 8 so that the coin 8 will not lose its generally horizontal posture despite the fact that it has passed out from under plate 25. At the same time, spring 27 permits the coin 8 to be tilted slightly so that the coin 8 can engaged in a spiral groove of the rotating column 20.

After being slightly rotated about column 20 by the rotation of the rotating column 20, the coins 8 inserted in the spiral grooves of the rotating column 20 are contacted by the wall surface 21*a* of the guide barrel 21, which prevents them from revolving farther about column 20. Since the rotating column 20 is rotated clockwise, the coins 8 inserted in the spiral groove of the rotating column 20 are normally pressed against the wall surface 21*a* and are lifted in that posture. Since four lines of spiral groove of the rotating column 20 are formed as shown in FIG. 3, the coins 8 are lifted by the height l corresponding to four lines of groove 4 during one rotation of the rotating column 20. The coins 8 raised to the upper portion f the rotating column 20 in the manner described are discharged from the discharge port 21*b* which is formed at the upper portion of the guide barrel 21. The discharged coins 8, as shown in FIG. 4, are pooled in a hopper 31 disposed immediately under the discharge port 21*b*. Upon operation of the money changer 30, a predetermined number of coins from among coins pooled in the hopper 31 are permitted to flow downwardly through a chute 32 provided at the bottom of the hopper 31 and are paid out into a coin receiver 33.

In the above-mentioned embodiment, four lines of spiral groove are formed on the rotating column 20. However, the number of lines of spiral grooving can be freely selected. Furthermore, it will be appreciated that many other modifications and variations of the present invention will readily occur to those skilled in the art without departing from the spirit and scope of the present invention.

What is claimed is:

1. A coin lifting device comprising a rotating disk which rotates about an upright axis so as to feed coins placed thereon;

a rotating body formed with a spiral groove, in which groove the periphery of the coins fed in a horizontal posture by said rotating disk is inserted, said rotating body being rotatable about an upright axis;

guide means disposed at the outer periphery of said rotating body and adapted to receive the coins inserted in said spiral groove and to prevent the coins from being disengaged from said spiral groove and to prevent the coins from revolving about said rotating body;

a coin discharge port formed in an upper portion of said guide means and adapted to discharge coins lifted by said spiral groove;

a base plate having a circular recess, said rotating disk being rotatably disposed in said circular recess, said base plate having a passageway connected to said recess, said passageway being of a size to pass only a single layer and a single row of coins which have left said rotating disk due to the centrifugal force imparted to the coins by the rotating disk; and a roller which rotates about an upright axis, said roller being so disposed that said passageway is sandwiched between said roller and said rotating body and coins entering said passageway are further pushed toward said rotating body by said roller.

2. A coin lifting device as claimed in claim 1, which further includes a spring plate, said spring plate being adapted to press yieldably downwardly on coins located between said roller and said rotating body.

3. A coin lifting device as claimed in claim 1, wherein said rotating disk, said rotating body and said roller are driven by one motor.

4. A coin lifting device as claimed in claim 3, wherein said rotating body is connected to said motor through a one-way clutch.

5. A coin lifting device comprising a rotating disk which rotates about an upright axis so as to feed coins placed thereon;

a rotating body formed with a spiral groove, in which groove only the periphery of the coins fed in a horizontal posture by said rotating disk is inserted, said rotating body being rotatable about an upright axis;

upright guide means disposed at the outer periphery of said rotating body and adapted to constrain the coins inserted in said spiral groove to remain in said spiral groove and to prevent the coins from revolving about said rotating body; and a laterally-opening coin discharge port formed in an upper portion of said guide means, said guide means terminating upwardly at a lower edge of said discharge port, whereby coins reaching the discharge port lose the constraint of said guide means and are discharged through said discharge port in a direction away from said rotating body.

* * * * *